US009974387B2

(12) United States Patent
Fissl

(10) Patent No.: US 9,974,387 B2
(45) Date of Patent: May 22, 2018

(54) MECHANISM FOR A CHAIR WITH A SYNCHRO MECHANISM; WEIGHT ADJUSTMENT METHOD FOR IMPROVED DYNAMIC SITTING EXPERIENCE ON THE PART OF THE SEAT USER BY MEANS OF A MECHANISM FOR A CHAIR WITH A SYNCHRO MECHANISM

(71) Applicant: Koenig + Neurath AG, Karben (DE)

(72) Inventor: Dietmar Fissl, Stuttgart (DE)

(73) Assignee: Koenig + Neurath AG, Karben (DE)

( * ) Notice: Subject to any disclaimer, the term of this patent is extended or adjusted under 35 U.S.C. 154(b) by 113 days.

(21) Appl. No.: 15/168,538

(22) Filed: May 31, 2016

(65) Prior Publication Data

US 2016/0345737 A1 Dec. 1, 2016

(30) Foreign Application Priority Data

Jun. 1, 2015 (DE) ..... 10 2015 006 760

(51) Int. Cl.
*A47C 1/032* (2006.01)

(52) U.S. Cl.
CPC ..... *A47C 1/03266* (2013.01); *A47C 1/03272* (2013.01)

(58) Field of Classification Search
None
See application file for complete search history.

(56) References Cited

U.S. PATENT DOCUMENTS 4,664,352 A * 5/1987 Shibuki ..... B60N 2/502 188/266.7
4,858,993 A * 8/1989 Steinmann ..... A47C 1/026 297/302.4

(Continued)

FOREIGN PATENT DOCUMENTS

DE 198 10 768 A1 9/1999
DE 103 02 208 A1 7/2004
DE 20 2011 108 433 U1 1/2012

*Primary Examiner* — David E Allred
(74) *Attorney, Agent, or Firm* — Collard & Roe, P.C.

(57) ABSTRACT

The invention is based on a mechanism (1) for a chair having a synchro mechanism by means of which a seat surface structure and a backrest structure are moved in a synchronized ratio relative to one another, wherein the mechanism (1) serves to adjust a restoring force of the synchro mechanism to a different body weight of a seat user by changing a working angle of a force accumulator, and the mechanism (1) includes a seat support (8) for the seat surface structure, a bearing yoke (5), the force accumulator unit (2) a backrest support (3) for supporting the backrest structure, and a translational bearing (16), wherein the mechanism (1) has a triangular steering block (21) and the force accumulator unit (2) is connected to the triangular steering block (21), and on a weight adjustment method for an improved dynamic sitting experience on the part of the seat user by means of a mechanism (1) for a chair with a synchro mechanism, in which the position of a first pivot point (31) of the force accumulator unit (2) is shifted by means of the adjuster (11) when the backrest support (3) is in a position (A), and a swivelling motion of the backrest support (3) into a second position (B) is not performed until the first step is completed.

9 Claims, 13 Drawing Sheets

(56) References Cited

U.S. PATENT DOCUMENTS

Figure 1:
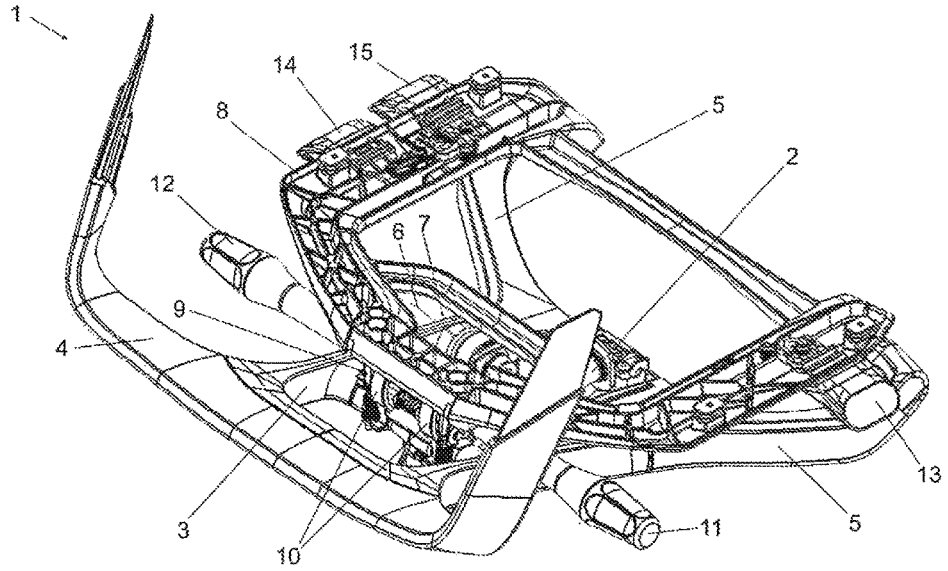

| | | | | |
|---|---|---|---|---|
| 5,564,783 | A * | 10/1996 | Elzenbeck | A47C 1/03255 297/300.2 |
| 7,080,884 | B2 | 7/2006 | Daeschle et al. | |
| 2010/0244522 | A1* | 9/2010 | Fukai | A47C 1/032 297/300.3 |
| 2014/0159452 | A1* | 6/2014 | Potrykus | A47C 1/03266 297/300.2 |
| 2014/0300158 | A1* | 10/2014 | Jones | A47C 1/03238 297/303.1 |
| 2016/0174720 | A1* | 6/2016 | Sander | A47C 7/441 297/303.4 |
| 2017/0367485 | A1* | 12/2017 | Salvoni | A47C 1/03272 |

* cited by examiner

SECTION B-B

MECHANISM FOR A CHAIR WITH A SYNCHRO MECHANISM; WEIGHT ADJUSTMENT METHOD FOR IMPROVED DYNAMIC SITTING EXPERIENCE ON THE PART OF THE SEAT USER BY MEANS OF A MECHANISM FOR A CHAIR WITH A SYNCHRO MECHANISM

STATE OF THE ART

The invention is based on a mechanism for a chair having a synchro mechanism and a method for setting a weight by means of a mechanism for a chair with a synchro mechanism.

Mechanisms for chairs having a synchro mechanism and methods for setting a weight by means of a mechanism for chairs with a synchro mechanism, particularly work and office chairs, have been established as part of the state of the art for a long time. These mechanisms enable the seat user to adapt and adjust the characteristics of the energy accumulator within certain limits to his or her individual weight. To do this, the preload force is set, and therewith the characteristics of the energy accumulator, often with the aid of an adjuster which is difficult to move. Moreover, setting the characteristics of the energy accumulator often involves cranking or turning a device on the stiff adjuster for a long time.

Utility model specification DE 20 2011 108 433 U1 seeks protection for a seating furniture design, that is to say an office chair with a synchro mechanism, wherein the rear area of the seat support is connected to the base support at multiple points via a coupling lever, and the coupling lever is forcibly actuated in the bearing point by the back wing. If the seat user leans backwards, the coupling lever is deflected in the bearing point by the back wing in such manner that the seat support is forced to follow the backrest and tilts also. The spring element is braced on the base support and exerts a restoring force on the back wing at a pivot point, wherein the position of the pivot point relative to a rotation point can be changed by means of helical cam, so that the restoring force of the spring element can be adjusted. The disadvantage of this system is that the restoring force, and consequently the preload force of the spring element as well, can only be adjusted within limited parameters, and still requires the application of significant physical force by means of the adjuster.

Patent document DE 198 10 768 A1 describes an office chair with a backrest support and a seat surface support, both of which are supported on a fixed-position chair support such that each is swivellable about a horizontal axis depending on the other, and which work against the restoring force of a compression spring located below the seat surface support, which increases as the tilt angle increases. The compression spring can only be changed when the office stool is in an unloaded condition, and this is performed by a mechanical gear system in such manner that a gearwheel of the manual rotary drive engages with the gearwheel of the rotating pressure plate. A disadvantage of this technical solution with regard to setting the preload force of the compression spring is that the rotary drive used to make the setting is stiff, slow and prone to malfunctions.

A chair with a rapidly adjustable force accumulator is described in application document DE 103 02 208 A1, wherein a swivelling backrest support is arranged on a seat element, said backrest being pretensioned against the user's back with a manually adjustable preload force from a force accumulator. The front end of the force accumulator is supported rotatably on a free, swivelling end of a steering block located close to a seat edge, and the rear end of the force accumulator is connected in articulated manner to a free, swivelling end of the backrest support, wherein this action point is designed to be adjustable and lockable. The disadvantage of this arrangement is that setting the preload force of the spring element requires the application of significant physical force.

The object underlying the invention is therefore to develop a mechanism for a chair with a synchro mechanism and a weight adjustment method using a mechanism for a chair with a synchro mechanism, wherein the mechanism enables a seat user to set the weight with almost no force application, and without changing the preload force of a force accumulator and therewith also the restoring force for the synchro mechanism.

The object is solved with a mechanism for a chair with a synchro mechanism and a weight adjustment method using a mechanism for a chair with a synchro mechanism according to the invention.

THE INVENTION AND ITS ADVANTAGES

The advantage of the mechanism according to the invention compared with the conventional mechanism is that it has a triangular steering block, and the force accumulator unit is connected to the triangular steering block. The mechanism according to the invention thus has the advantage that because of this arrangement of triangular steering block and force accumulator unit the gear system creates a progressive load on the force accumulator of the force accumulator unit via the spindle integrated in the triangular steering block. A further advantage of the mechanism according to the invention is that the preload force of the force accumulator is not changed when setting the weight to a given seat user's body weight, but instead a restoring force of the synchro mechanism is adjusted to a different seat user's body weight without the application of force, by changing the working angle of the force accumulator with respect to the triangular steering block. Further advantages include the optimal use of the installation space and the fact that this arrangement enables lever action to be applied very efficiently to the force accumulator unit.

According to an advantageous variant of the mechanism according to the invention, the mechanism includes a connector arranged on the backrest support. Installation of a connector creates a connection between the triangular steering block and the backrest support, resulting in an improved dynamic sitting experience for a seat user, because this connection between the connector and the triangular steering block creates a further axis of rotation for the triangular steering block. Moreover, it is also possible to design the connector as an integral component of the backrest support, resulting in enhanced stability and a reduction of parts, which in turn results in minimal manufacturing effort.

According to an advantageous variant of the mechanism according to the invention, the mechanism includes a bearing lever that is arranged so as to be rotatable about an axis of the bearing yoke. The advantage of this is that the change in the position of the bearing lever from a rear position to a front position further increases the progression of the force accumulator due to an improved lever ratio.

According to another advantageous variant of the mechanism according to the invention, the force accumulator is connected to the triangular steering block via a joining means. The joining means enables the constructor to connect the force accumulator to the triangular steering block considerably more easily and with less space requirement.

According to another advantageous variant of the mechanism according to the invention, the triangular steering block is rotatable about a horizontal axis of the connector and about the horizontal axis of the bearing lever. The advantage of this is that the simultaneous rotary motion of the triangular steering block about two axes results in improved progression of the force accumulator, as this enables the lever action to be applied to the force accumulator more efficiently.

According to another advantageous variant of the mechanism according to the invention, the mechanism includes a gear system that is adjustable via an adjuster. The advantage of this is that the gear system can be adjusted easily and conveniently by a seat user via the adjuster, which is particularly in the form of a handle. An automatic weight adjusting means may also be provided optionally, so that the weight of a seat user with the chair in position (A) is detected by a sensor means for example, and the working angle of the force accumulator relative to the triangular steering block is thereafter optimised automatically for the weight of the seat user.

According to a related advantageous variant of the mechanism according to the invention, the gear system is arranged on the triangular steering block. The advantage of this is that this construction minimises the space requirement for installation in the chair.

According to another advantageous variant of the mechanism according to the invention, the gear system includes a spindle. The advantage of the spindle is that as part of the gear system the spindle enables a rotary motion of the adjuster to be transmitted to the gear system, wherein the spindle, as part of the gear system converts the rotary motion of the adjuster, particularly a handle, into a translational motion, thereby changing the position of the adjuster's first pivot point in the slot in the triangular steering block. Depending on the spindle position, in this way it is possible to achieve a significant translational shift of the pivot point with just a small rotary motion of the adjuster. The spindle must be aligned at an inclination of at least such a degree that the spindle blocks itself under load through internal friction.

According to another advantageous variant of the mechanism according to the invention, the gear system's spindle acts on the joining means in such manner that the position of a first pivot point of the force accumulator is adjustable. The advantage of this mechanism is that the first pivot point of the force accumulator can be shifted by a seat user by means of an adjuster via a spindle in the gear system quickly, easily and without malfunction, and particularly without physical force, so that the working angle of the force accumulator in the force accumulator unit relative to the triangular steering block and thus also the restoring force acting on the synchro mechanism, with the result that the seat user is able to enjoy a seating experience in which the chair is adapted dynamically to his weight.

According to a related advantageous variant of the mechanism according to the invention, the first pivot point of the force accumulator unit is shifted through an angle relative to its line of action. The advantage of this is that shifting the first pivot point of the force accumulator relative to its line of action enables maximum adjustment relative to the length of the spindle when the adjuster, particularly a handle, is rotated.

According to a related advantageous variant of the mechanism according to the invention, the first pivot point (31) of the force accumulator unit (2) is shifted perpendicularly to its line of action (61). The advantage of this is that the perpendicular shift of the force accumulator unit, particularly the force accumulator enables the force accumulator unit to be shifted without the use of force via the gear system spindle either manually by the seat user or by electronic or similar means. The force accumulator unit is preferably equipped with a spring as the force accumulator, particularly a helical spring or similar. The advantage of a spring, particularly a helical spring, consists in that the spring characteristics can be configured with areas of variable wire diameter, varying pitch or variable spring diameter (frustoconical helical spring) to achieve a high degree of flexibility with regard to the force accumulator of the force accumulator unit. In particular, progressive springs are used, i.e., as the load increases, so the spring becomes more resistant to prevent it from bottoming out under heavy loads.

The advantage of the method according to the invention for setting a weight by means of a mechanism for a chair with a synchro mechanism compared with the conventional method is that the mechanism has a triangular steering block, and the force accumulator unit is connected to the triangular steering block, wherein when the backrest support is in a position A, the position of a first pivot point of the force accumulator unit is shifted by means of the adjuster and a swivelling motion of the backrest support into a second position B is not performed until the first step is completed. The advantage of the method according to the invention consists in that the restoring force of the chair, particularly a work or office chair, can be shifted and set quickly, easily, without malfunction and without physical force, by the seat user so that the seat user is then able to enjoy a dynamically adapted seating experience optimised for his weight. Moreover, since the line of action of the force accumulator unit, particularly the force accumulator, is shifted without applying physical force, without changing the preload force, of the force accumulator, the gear system exerts a progressive load from the force accumulator via the spindle that is integrated in the triangular steering block.

According to another advantageous variant of the method according to the invention, when the backrest support is swivelled into the second position B, the triangular steering block simultaneously executes a first rotary motion about a horizontal axis of a connector as indicated by a dashed arrow and a second rotary motion about a horizontal axis of a bearing lever as indicated by a dashed arrow. The advantage of this simultaneous rotary motion of the triangular steering block about two axes is that the shift of the pivot point in the first method step in position D provides an improved lever ratio for heavy individuals, thereby enabling better progression when the force accumulator is placed under load.

According to another advantageous variant of the method according to the invention, when the backrest support is swivelled into the second position B, the bearing lever is shifted about the horizontal axis of the bearing yoke from a rear base position to a front position. The advantage of this is that the change of the lever position from a rear base position to a front position serves to further increase the progression of the force accumulator under load due to an improved lever ratio.

According to another advantageous variant of the method according to the invention, the mechanism for a chair having a synchro mechanism is a mechanism according to the invention.

Further advantages and advantageous configurations of the invention are described in the following description, the claims and the drawing.

DRAWING

Figure 2:
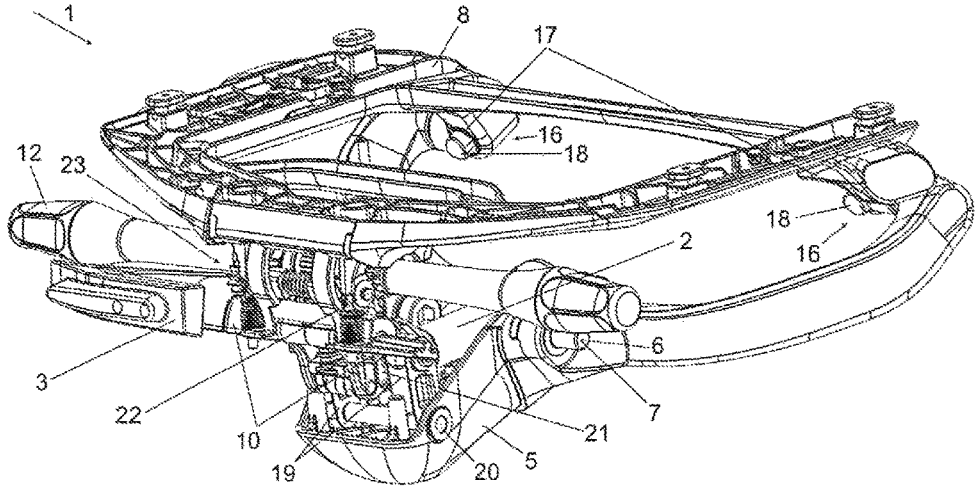
Figure 3:
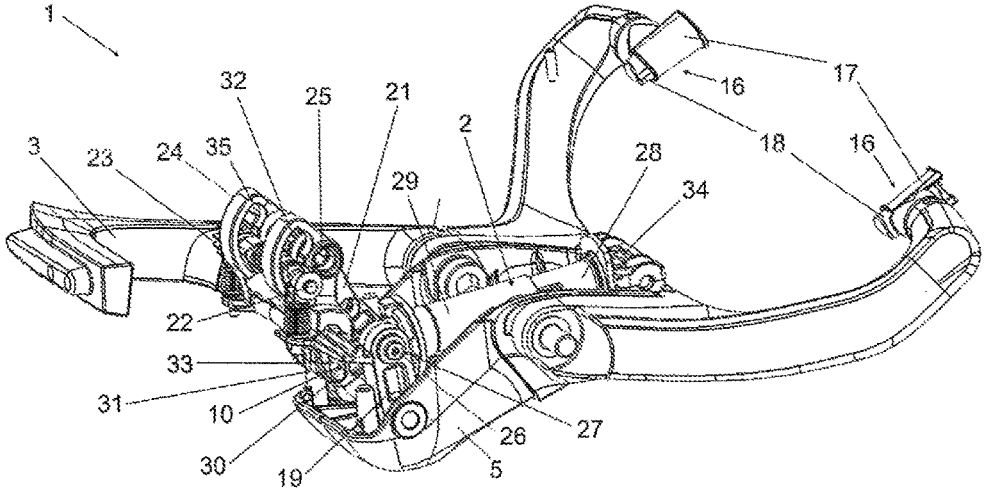
Figure 4:
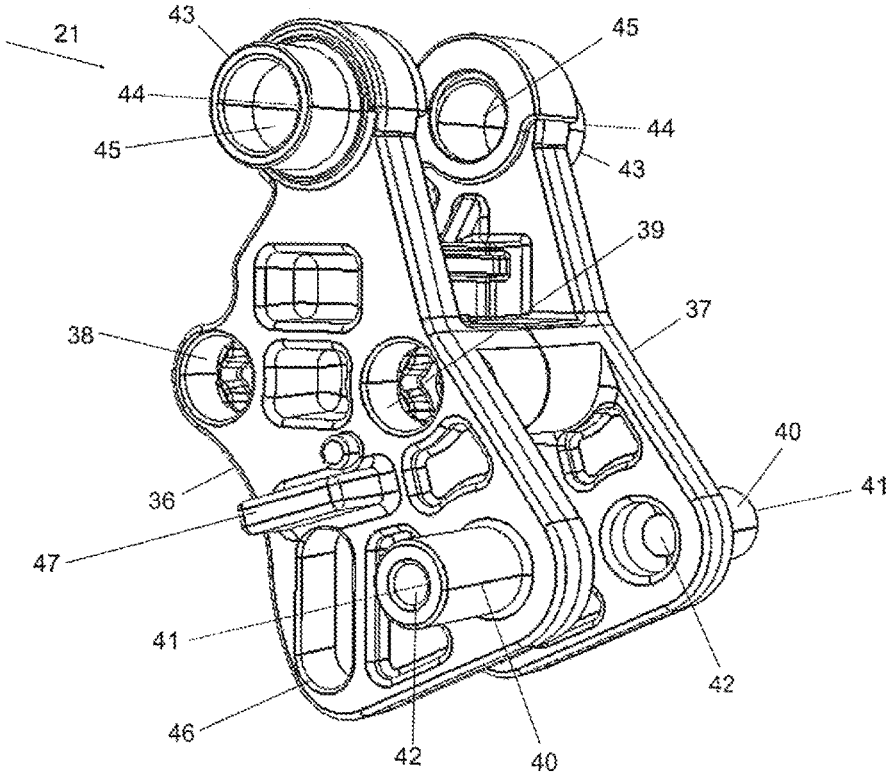
Figure 5:
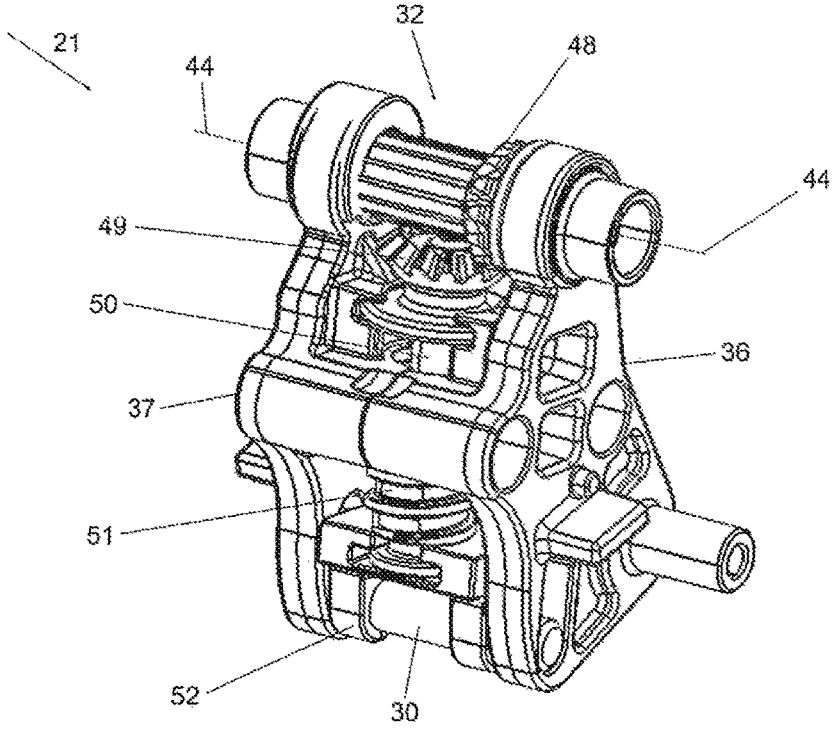
Figure 6:
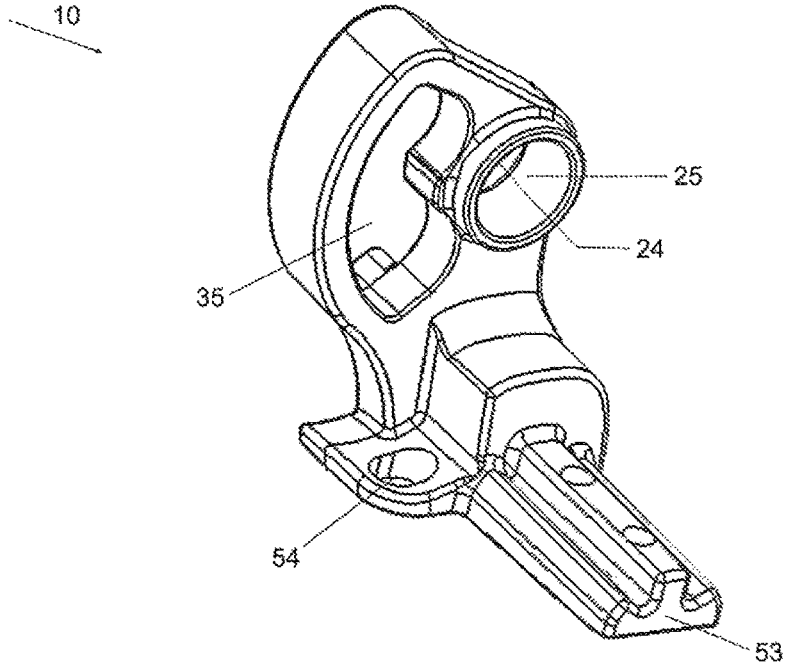
Figure 7:
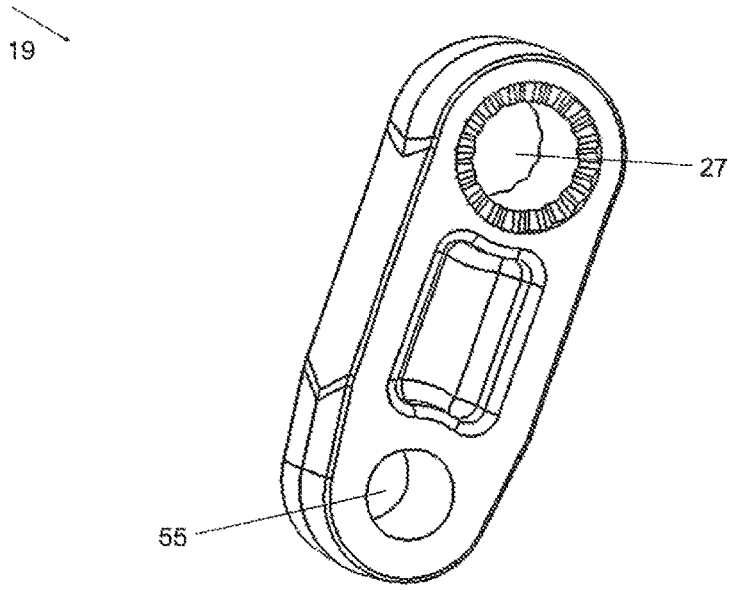
Figure 8:
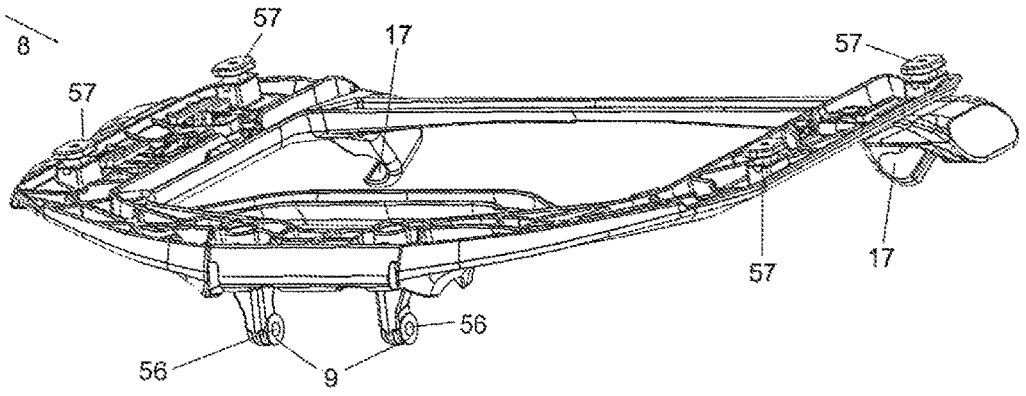
Figure 9:
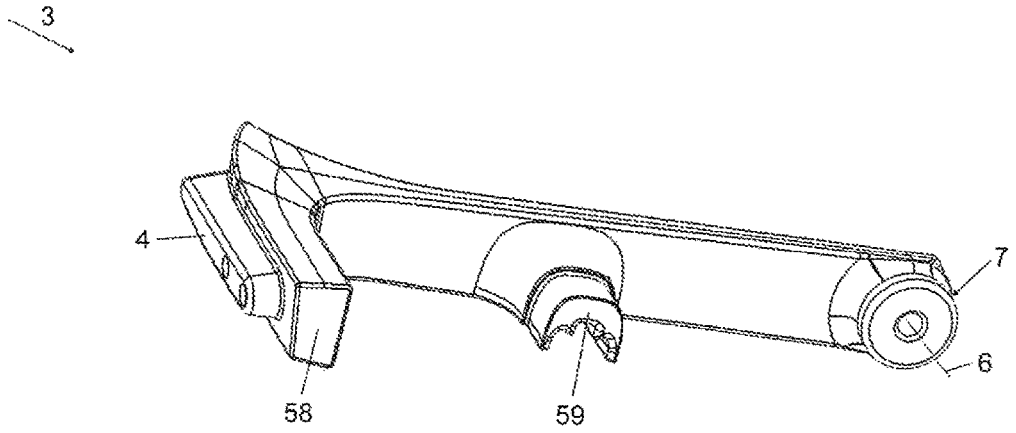
Figure 10:
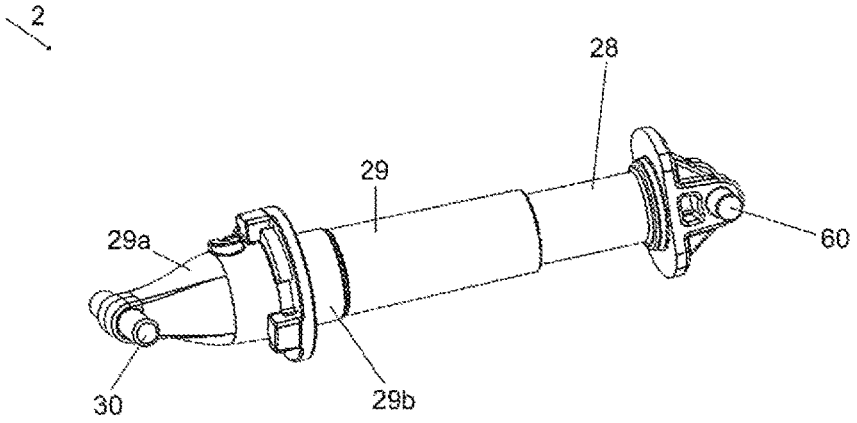
Figure 11:
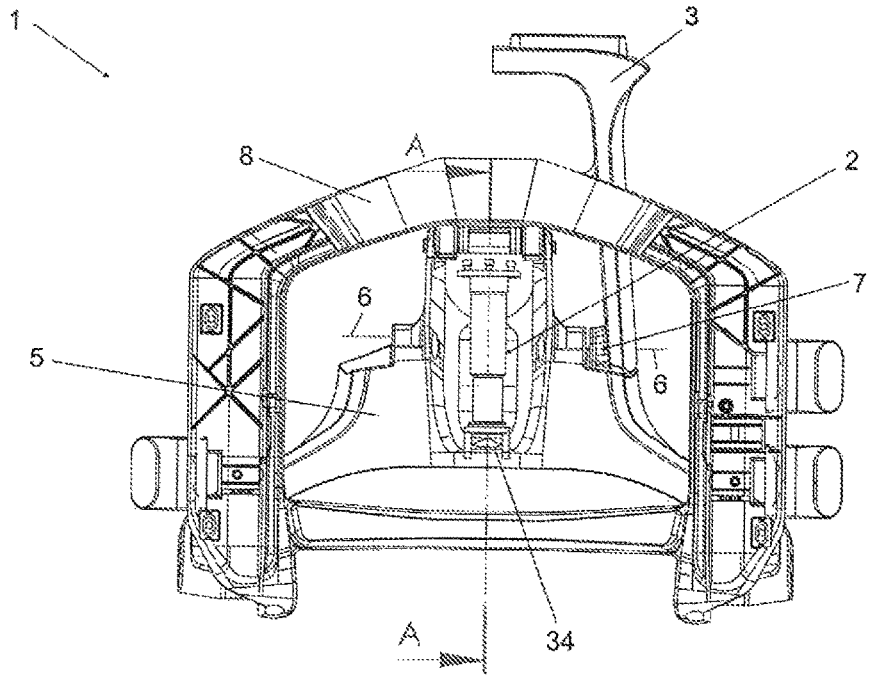
Figure 12:
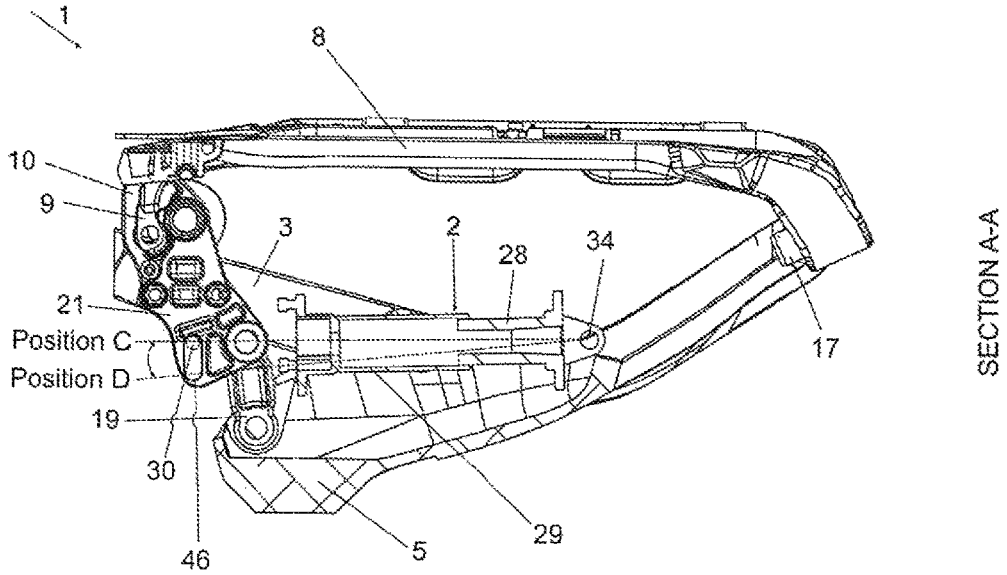
Figure 13:
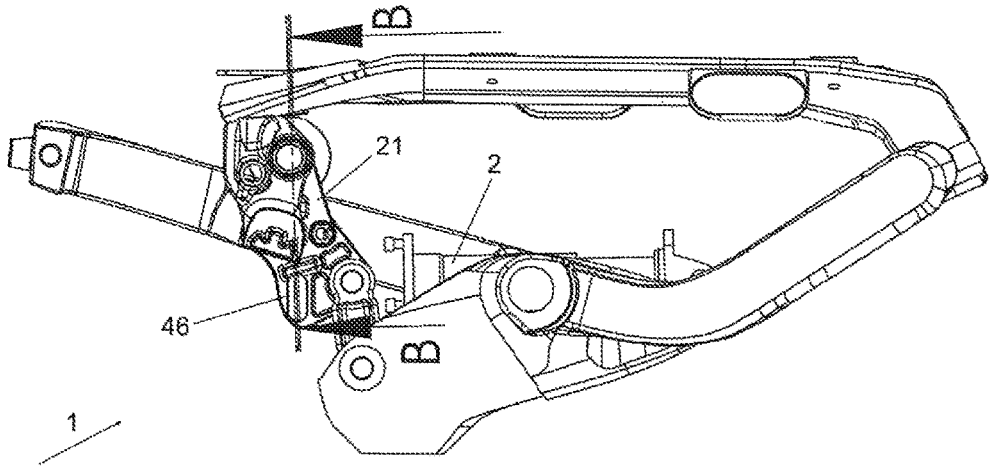
Figure 14:
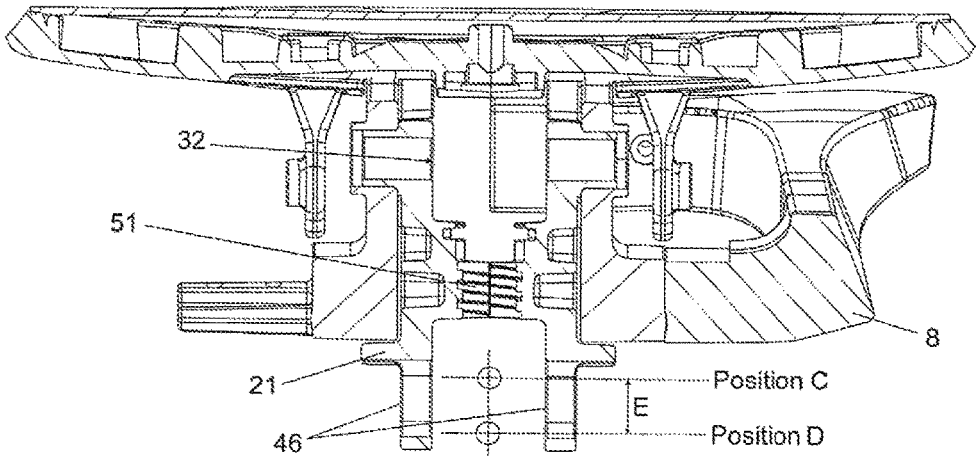
Figure 15:
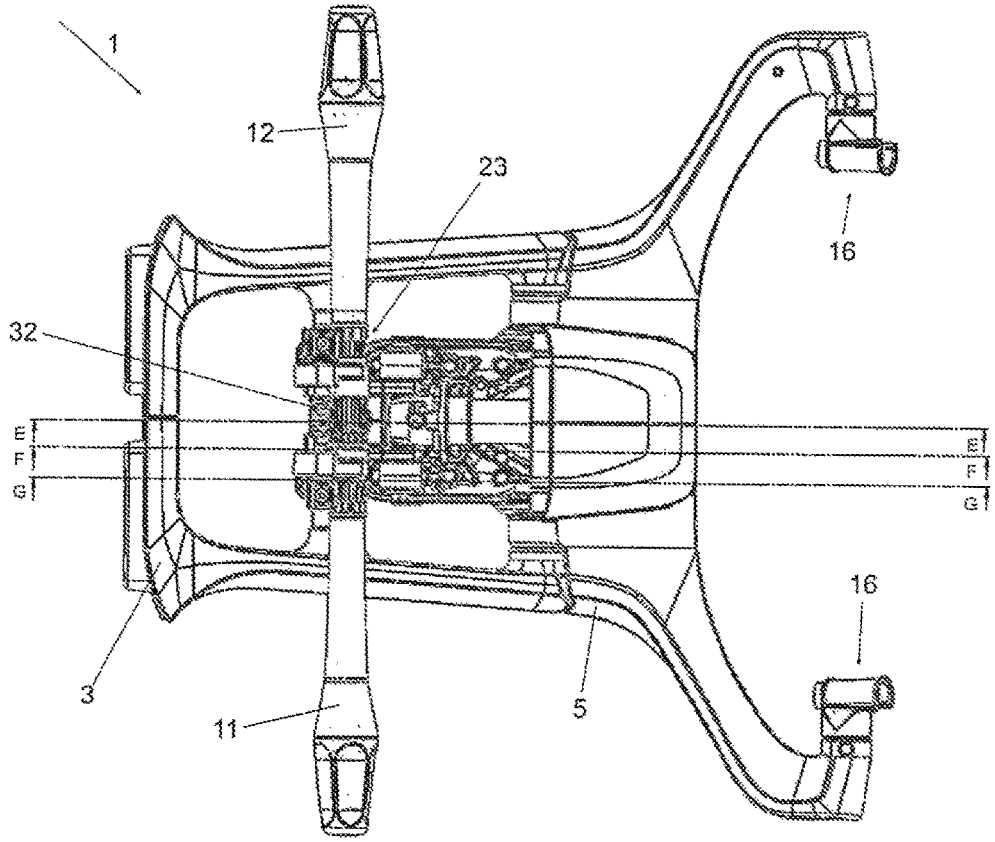
Figure 16:
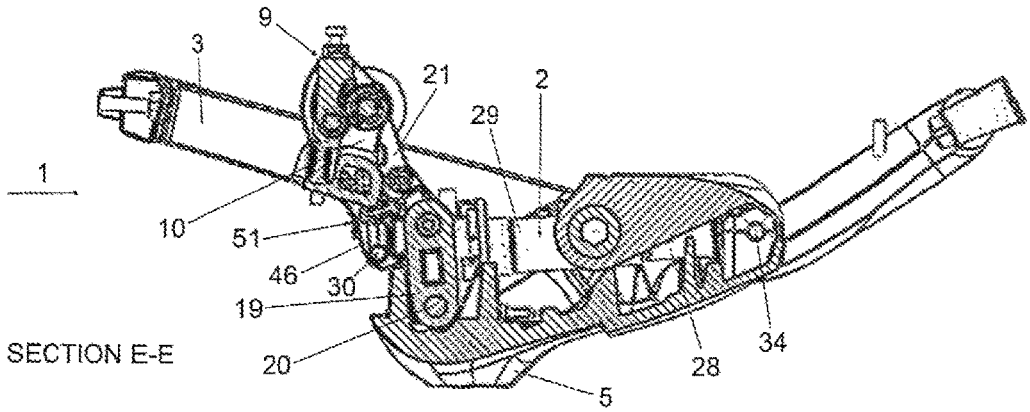
Figure 17:
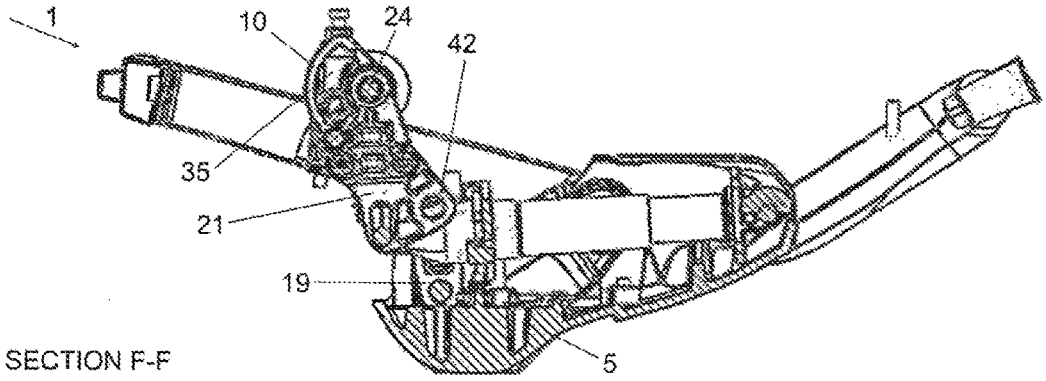
Figure 18:
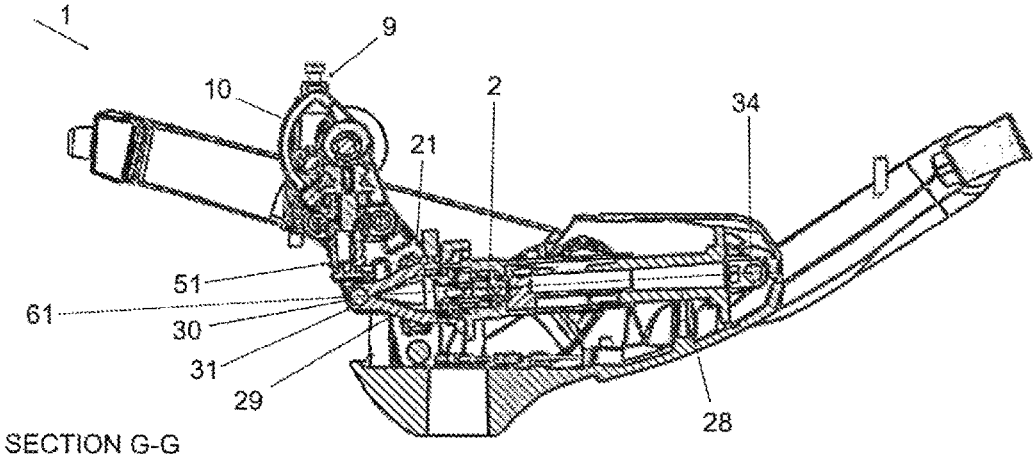
Figure 19:
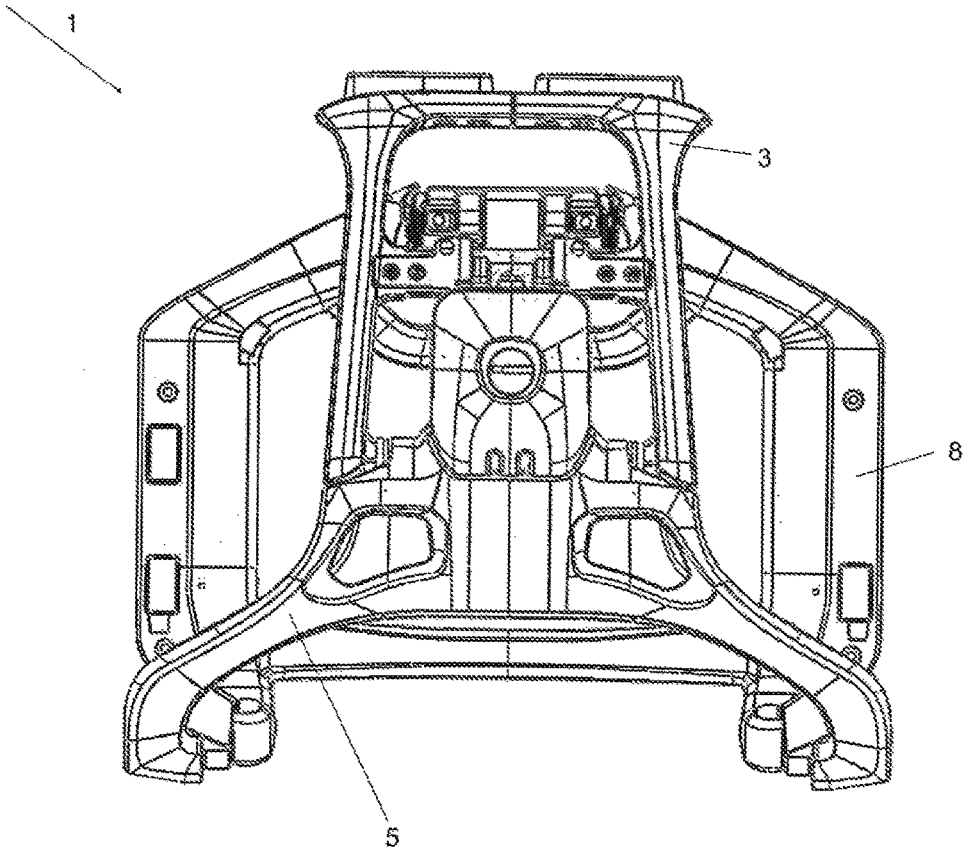
Figure 20:
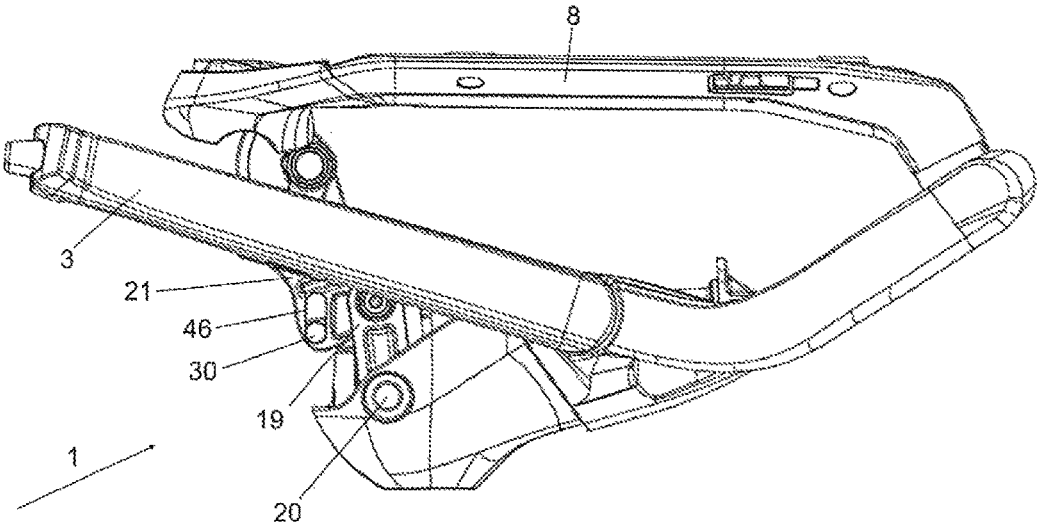
Figure 21:
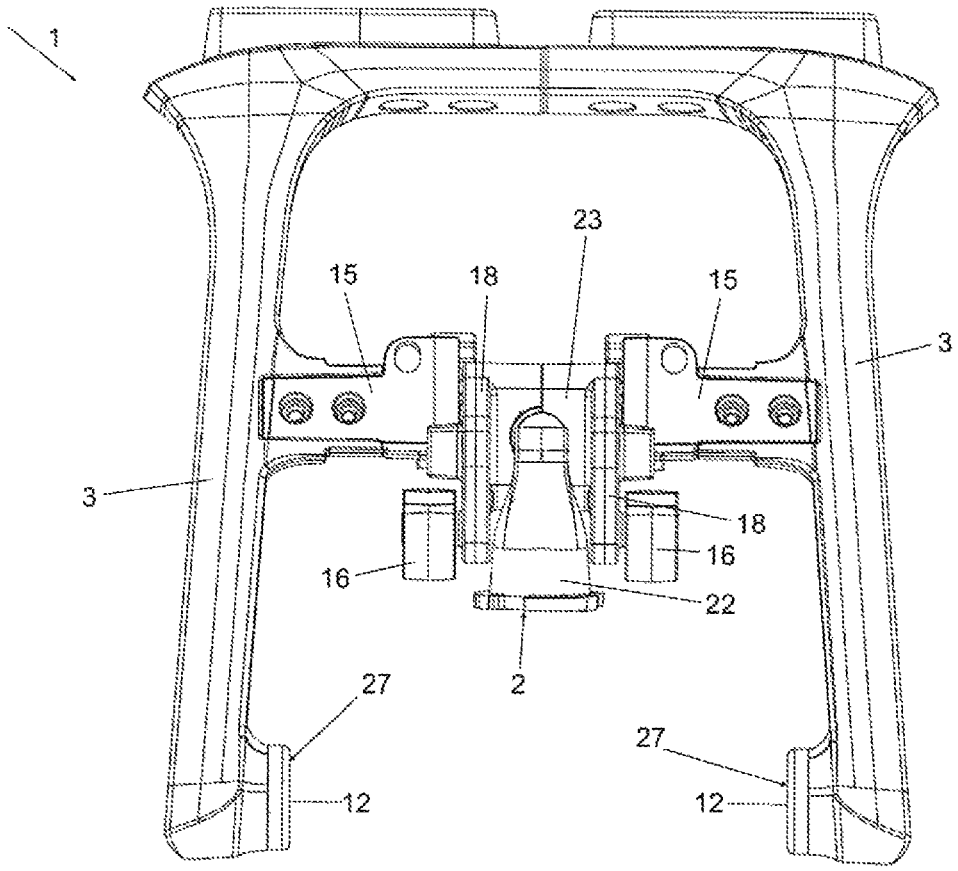
Figure 22:
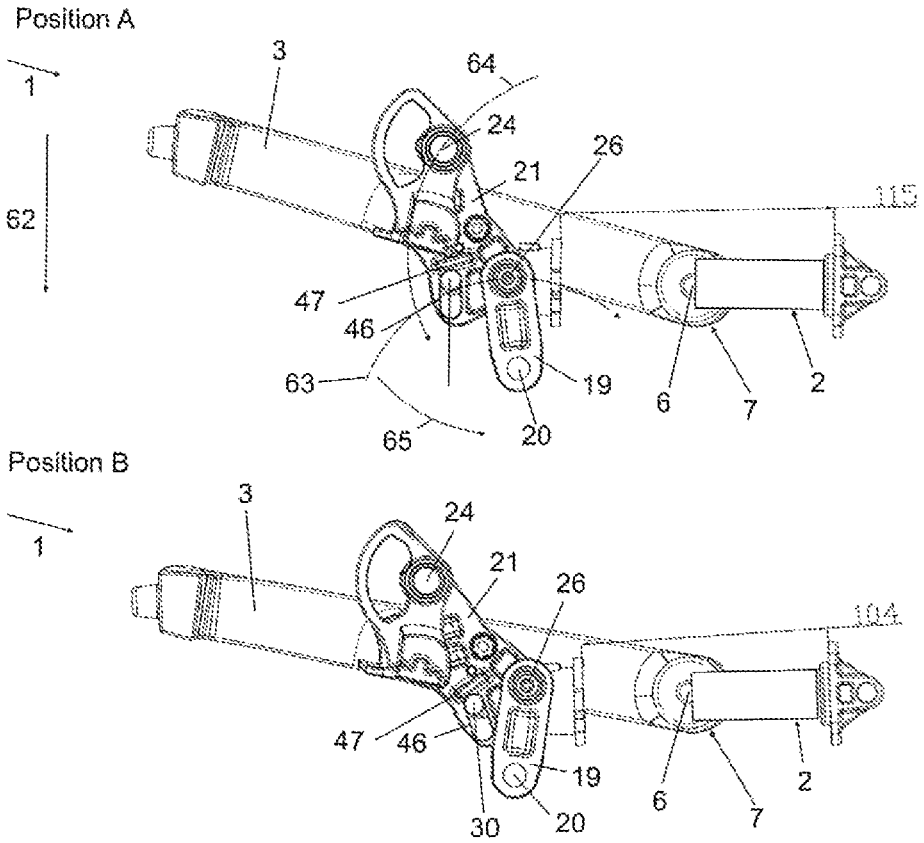
Figure 23:
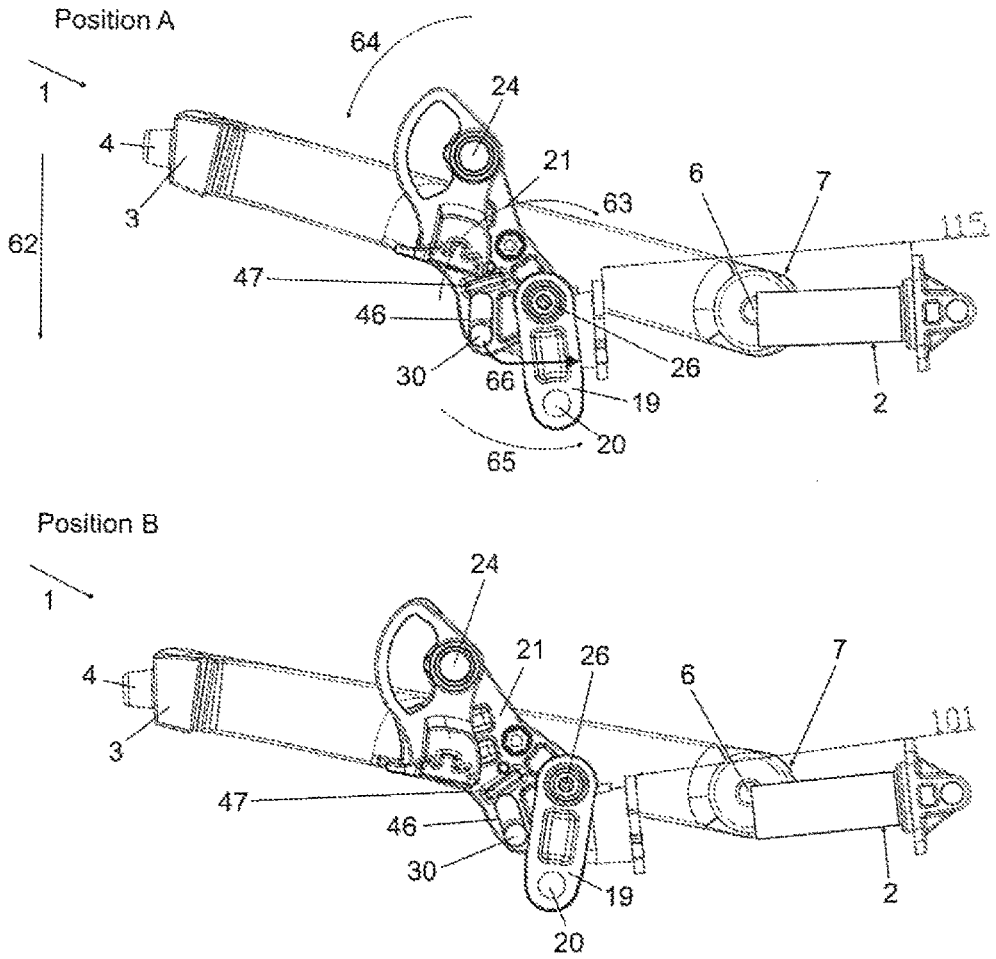
Figure 24:
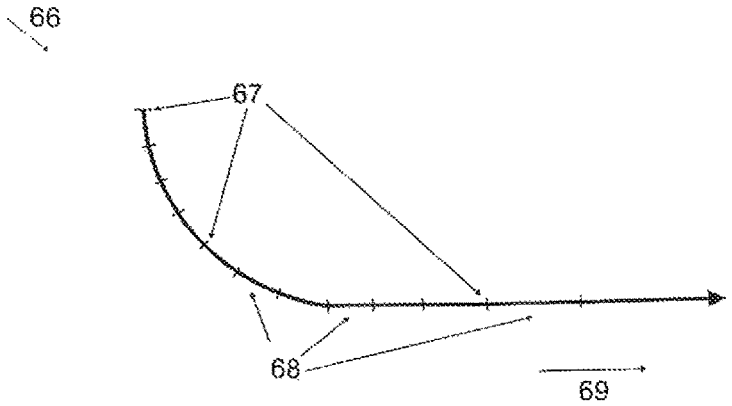

Preferred embodiments of the object according to the invention are represented in the drawing and will be explained in greater detail in the following text. In the drawing:

FIG. 1 is a perspective view from above of an embodiment of a mechanism according to the invention for a chair, particularly a work or office chair, FIG. 2 is another perspective view of the mechanism according to the invention represented in FIG. 1, wherein certain elements have been hidden, FIG. 3 is a third perspective view of the mechanism according to the invention for a chair as represented in FIG. 1 with certain elements hidden, FIG. 4 is a perspective view of a triangular steering block for a mechanism according to the invention for a chair, FIG. 5 is a perspective view of the triangular steering block represented in FIG. 4 for a mechanism for a chair with a gear system, FIG. 6 is a perspective view of a connector for a mechanism for a chair, FIG. 7 is a perspective view of a bearing lever for a mechanism for a chair, FIG. 8 is a perspective view of a seat support for a mechanism for a chair, FIG. 9 is a perspective view of one half of a backrest support for a mechanism for a chair, FIG. 10 is a perspective view of a force accumulator unit for a mechanism for a chair, FIG. 11 is a view of an embodiment of a mechanism according to the invention for a chair, particularly a work or office chair, with a horizontal section plane A-A, FIG. 12 shows the section A-A of FIG. 11, wherein the backrest support of the chair is in a position A (working position), FIG. 13 is a side view of an embodiment of a mechanism according to the invention for a chair, particularly a work or office chair, with a vertical section plane B-B, FIG. 14 shows the section B-B of FIG. 13 of a mechanism for a chair, particularly a work or office chair, wherein the backrest support is in a position A (working position), FIG. 15 is a top view of an embodiment of a mechanism according to the invention for a chair with three horizontal section planes, E-E, F-F and G-G, FIG. 16 shows horizontal section E-E of FIG. 15 of a mechanism for a chair, FIG. 17 shows section F-F of FIG. 15 of a mechanism for a chair, particularly a work or office chair, FIG. 18 shows section G-G of FIG. 15 of a mechanism for a chair, FIG. 19 is a view from below of an embodiment of a mechanism according to the invention for a chair, FIG. 20 is a side view of the view from below of FIG. 19 of a mechanism according to the invention for a chair, FIG. 21 is a view from below of an embodiment of a mechanism for a chair, particularly a work or office chair, FIG. 22 shows two side views of an embodiment of a mechanism according to the invention for a chair, particularly a work or office chair, in a position A (working position) and in a position B (relaxing position), wherein the force accumulator unit is in a raised position, FIG. 23 shows two side views of an embodiment of a mechanism according to the invention for a chair, in a position A (working position) and in a position B (relaxing position), wherein the force accumulator unit is in a lowered position, FIG. 24 is an exemplary load curve that is created by the mechanism according to the invention during a swivelling motion from a position A (working position) to a position B (relaxing position).

DESCRIPTION OF THE EMBODIMENTS

FIG. 1 is a perspective view from above of an embodiment of a mechanism 1 according to the invention for a chair, particularly a work or office chair, having a synchro mechanism, by means of which a seat surface structure and a backrest structure are moved in synchronised manner relative to one another, wherein the mechanism serves to adjust a restoring force of the synchro mechanism to a different body weight of a seat user by changing a working angle of a force accumulator unit 2, particularly a force accumulator. The partially shown backrest structure includes, besides other components, a backrest support 3 and a mounting 4 for a backrest (not shown). Backrest support 3 is arranged on bearing yoke 5 so as to be rotatable about a horizontal axis 6 of bearing yoke 5, a main rotary bearing 7. The seat surface structure includes a seat support 8 and cushioning (not shown). A front area of seat support 8 is connected to bearing yoke 5 via at least one translational bearing, and the rear area thereof is connected via at least one support 9 to at least one connector 10, two connectors 10 in the embodiment shown. Mechanism 1 is further equipped with an adjuster 11 for changing the tilt angle of the force accumulator unit 2 and an adjuster 12 for setting the tilt angle of seat support 8. The capability to make automatic weight adjustments is also provided; the weight of the seat user in a position A is registered for example by a sensor means, and the force accumulator (not shown) of force accumulator unit 2 is then set automatically to the seat user's weight as registered by the sensor means. A height adjustment device 13, a seat depth adjustment device 14 and an aperture angle limiter 15 are provided for adjusting the chair and the seat structure in terms of these parameters via a linkage system (not shown) arranged in seat support 8.

FIG. 2 shows a perspective view of the inventive mechanism 1 for a chair of FIG. 1, also referred to as a non-orbiting gear system, in which mounting 4 for a backrest and one half of backrest 3 are not illustrated to allow clearer representation and visibility. Backrest support 3 is arranged on bearing yoke 5 so as to be rotatable about a horizontal axis 6 of bearing yoke 5, the main rotary bearing 7 (not shown). Seat support 8 is moved by two translational bearings 16, wherein bearings 16 of such kind include a seat support guide 17 and a seat support bearing 18. The mechanism 1 according to the invention includes at least one backrest support 3, at least one connector 10, at least one main rotary bearing 7, at least one bearing lever that is arranged so as to be rotatable about a horizontal axis 20 of bearing yoke 5, and a triangular steering block 21. FIG. 2 further shows the attachment of seat support 8 to connectors 10 via supports 9 and by a horizontally and vertically spring-loaded linkage means 22. Adjuster 12 enables the tilt angle of seat support 8 to be set via a gear system 23.

FIG. 3 shows a perspective representation of the inventive mechanism 1, certain structural elements represented in FIGS. 1 and 2 are not illustrated. In FIG. 3, triangular steering block 21 is represented, which is rotatable about a horizontal axis 24 of a borehole 25 in the at least one connector 10 and about a horizontal axis 26 of borehole 27 in the at least one bearing lever 19. Force accumulator unit 2 with a force accumulator (not shown), particularly a spring, here specifically a helical spring, a first guide element 28 and a second guide element 29, wherein the second guide element 29 of force accumulator unit 2 is connected to triangular steering block 21 by a linkage means 30. Linkage means 30 thus forms a first pivot point 31 of the second guide element 29 of the force accumulator unit 2 on triangular steering block 21. Triangular steering block 21 further includes a gear system 22 with a spindle, by means of which the linkage means 30 may be displaced in its position in a slot 33 in the triangular steering block 21. Said gear system is operated by adjuster 11 (not shown). A second pivot point 34 of the first guide element 28 of force accumulator unit 2 is arranged in the front area of bearing yoke 5. The first guide element 28 is arranged in fixed manner yet rotatably about this second pivot point 34. The two guide elements 28 and 29 of force accumulator unit 2 are arranged such that they are displaceable relative to one another, wherein in the embodiment shown the first guide element 28 is accommodated inside the second guide element 29, and a force accumulator (not shown) particularly a helical spring, is positioned between the two guide elements 28 and 29. Each of the guide elements 28 and 29 may consist of multiple individual interconnected parts. Backrest support 3 is arranged in fixed position on main rotary bearing 7 so as to be rotatable about a horizontal axis 6 of bearing yoke 5. Seat support 8 is moved by a translational bearing 16, which has a seat support guide 17 and a seat support bearing 18. Seat support 8 is also connected to mechanism 1 via a gear system 23 which can be set by a second adjuster 12 via a linkage means 22 which is displaceable in a curvilinear slot 35 in the at least one connector 10. By displacing linkage means 22 in the curvilinear slot 35 in connector 10, it is possible to change the tilt angle of the seat surface structure (not shown). Linkage means 22 is connected to connector 10 by a spring-loaded structure.

FIG. 4 is a perspective view of a triangular steering block for a mechanism 1 according to the invention for a chair, also referred to as a non-orbiting gear system. Triangular steering block 21 is approximately triangular in shape, wherein each of the two halves 36 and 37 of triangular steering block 21 has two boreholes 38 and 39 to enable the two halves 36 and 37 to be screwed together, each has a bearing lever bearing 40 with a horizontal axis 41 of a borehole 42 for connecting to a bearing lever 19 (not shown here), each has a connector bearing 43 with a horizontal axis 44 of a borehole 45 for connecting to a connector 10 (not shown here), each has a slot 46 for accommodating the linkage means (30) (not shown here) between the triangular steering block 21 and the force accumulator unit 2, and a limit stop 47 to limit a swivelling motion against a bearing lever 19 (not shown here).

FIG. 5 is a perspective view of the triangular steering block 21 for a mechanism 1 of a chair with a gear system 32 that is arranged between the two component halves 36 and 37 as represented in FIG. 4. Gear system 32 includes a gearwheel 48 arranged perpendicularly to a horizontal axis 44 of connector bearing 43, which gear system is driven by adjuster 11 (not shown here), which also lies on the horizontal axis 44. Gear system 32 also has a further gearwheel 49 between the two component halves 36 and 37, arranged perpendicularly to gearwheel 48, which is driven by gearwheel 48 and in turn drives a spindle 51 via linkage means 50. The arrangement of gear system 32 serves to convert a rotary motion of adjuster 11 into a translational motion of spindle 51. In turn, spindle 51 is connected to a component 52, which accommodates linkage means 30 in slot in the triangular steering block 21. The pitch of spindle 51 is configured in such manner that spindle 51 blocks itself due to internal friction on the flanks when a load is applied, by a seat user for example. In the embodiment shown, the spindle pitch is about two, although other spindle pitches are also conceivable. However, it is important that the spindle pitch is always large enough to guarantee a self-blocking action. Thus, the gear system 32 makes it possible for the seat user to change the angle of force accumulator unit 2 (not shown here) without applying any force and without setting a different preload force of the force accumulator (not shown), which is particularly a helical spring, in force accumulator unit 2.

FIG. 6 shows a perspective view of a connector 10 of the mechanism 1 according to the invention. In the embodiment shown, connector 10 has a T-shaped connecting member 53 with at least one borehole, which is/are used for screwing on a backrest support 3 (not shown here). In this context, other joining options are also possible, such as a plugged connector or similar between connector 10 and backrest support 3. This enables connector 10 to be joined to backrest 3 very easily. The possibility exists to design backrest 3 in such manner that connector 10 forms an integral part of the backrest. Connector 10 also has a borehole 25 on a horizontal axis 24 for attachment to triangular steering block 21. Connector 10 is thus seated on a connector bearing 42 (not shown here) of triangular steering block 21. Connector 10 also has a curvilinear slot 35, which is arranged at a certain aperture angle about the horizontal axis 24 of borehole 25 to enable connection to triangular steering block 21. Curvilinear slot 35 may also be in the form of a simple borehole. With such a design, however, it is not possible to shift the tilt of seat support 8. A borehole 54, in the form of a threaded union, for example, serves for fastening a spring-loaded construction to seat support 8 (not shown here).

FIG. 7 shows a perspective view of a bearing lever 19 for the mechanism 1 according to the invention. Bearing lever has two boreholes 20 and 47, which serve to attach bearing lever 19 to a triangular steering block 21 and to attach it to a bearing yoke 5.

FIG. 8 shows a perspective view of seat support 8 for the mechanism 1 according to the invention, also referred to as a non-orbiting gear system, for a chair, particularly a work or office chair. Seat support 8 has at least one seat support guide 17 for translational motion of seat support 8, and at least one support 9 on a connector 10 (not shown), wherein boreholes 56 in the at least one support 9 accommodate gear system 23 (not shown here) and at least partly connect a force accumulator structure (also not shown here), particularly a spring structure to the support with a borehole 54 (not shown here) in connector 10. Seat support 8 also includes at least one device 57 for connecting seat support 8 with a seat surface structure (not shown).

FIG. 9 represents a perspective view of one half of a backrest support 3. The second, symmetrical half mirrors the first half along plane 58, as shown in FIG. 1. The rear area thereof includes a mounting 4 for a backrest (not shown), the middle area has a connection device 59 for accommodating connector 10, particularly by means of a threaded connection, in this case having a T-shaped profile, and the front area has a main rotary bearing 7, which is arranged so as to be rotatable about a horizontal axis 6 of bearing yoke 5.

FIG. 10 shows a perspective view of a force accumulator unit 2, wherein force accumulator unit 2 consists of a force accumulator (not shown), a first guide element 28 and a second guide element 29. In this context, guide elements 28 and 29 may consist of multiple parts. The front, first guide element 28 fits into the second, rear guide element 29, and a force accumulator, for example a spring, particularly a helical spring, is arranged between the two guide elements 28 and 29. Force accumulator unit 2 is connected to triangular steering block 21 (not shown here) via the second guide element 29, which consists of two parts 29*a* and 29*b*, by means of a linkage means 30, in this case a bolt. As was explained with reference to FIG. 3, first guide element 28 is arranged in the front area in fixed manner with a linkage means 60, particularly a bolt, so as to be rotatable about the second pivot point 34 (not shown here).

FIG. 11 represents a top view of the mechanism 1 according to the invention for a chair, particularly a work or office chair, with a horizontal section plane A-A, wherein said plane is aligned centrally in the lengthwise direction of the chair. The top view shows seat support 8, on which the seat surface structure (not shown) can be arranged, bearing yoke 5 with force accumulator unit 2, which is supported in fixed manner so as to be rotatable about second pivot point 34, and main rotary bearing 7, in which backrest support 3 is arranged rotatably about the horizontal axis 6 of bearing yoke 5, and backrest support 3 is in a first position A (working position).

FIG. 12 shows section A-A through the mechanism 1 according to the invention, also referred to as a non-orbiting gear system, of a chair of FIG. 11, wherein the chair is in a first position A (working position), that is to say the backrest support 3 has not undergone any swivelling motion. In position A (working position), bearing lever 19 is in a starting position, tilted slightly to the rear, i.e. in the direction of the backrest (not shown). Seat support 8 is connected via the translational bearing 16 (not shown) to a seat support guide 17 and a seat support bearing 18, and to bearing yoke 5, and is also in spring-biased connection with a gear system 23 (not shown here) via the at least one support 9 with connector 10 for adjusting the tilt angle of seat support 8. Seat support 8 is in a horizontal position A (working position). First guide element 28 of force accumulator unit 2 is rotatably mounted in fixed manner in second pivot point 34 and is accommodated in second guide element 29, wherein second guide element 29 is connected to triangular steering block 21 via linkage means 30. Linkage means 30, particularly a bolt, is accommodated in a slot 46 in triangular steering block 21 and forms first pivot point (not shown). When adjuster 11 (not shown) is rotated, gear system 32 is actuated, and acts via spindle 51 on linkage means 30 at an angle, and particularly perpendicularly with the line of action thereof, so that the angle of the force accumulator of force accumulator unit 2 may be shifted anywhere between preset positions C and D, but without altering the preload force of the force accumulator, particularly a helical spring. Positions C and D define the end positions of the stepless weight setting. In this context, position C is the setting for the minimum body weight that can be set for a seat user, and position D is the setting for the maximum body weight that can be set for a seat user. Thus, the length of slot 46 is responsible for defining the maximum possible body weight range of the weight setting, while the magnitude of the load may be set and changed by the body weight of a seat user via the force accumulator of force accumulator unit 2.

FIG. 13 represents a side view of the inventive mechanism 1 for a chair, particularly a work or office chair, with a vertical section plane B-B. The vertically aligned section plane B-B then intersects mechanism 1 in slot 46 of triangular steering block 21. In this way, a working angle of force accumulator unit 2 is changed angularly, particularly perpendicularly by spindle 51 (not shown here) while the chair is in the zero position (position A). The perpendicular angle of action of the spindle 51 (not shown) on force accumulator unit 2 enables the working angle to be shifted without the application of any force.

FIG. 14 shows the section B-B of FIG. 13 of the mechanism 1 according to the invention, also referred to as a non-orbiting gear system, of a chair, particularly a work or office chair, wherein section B-B extends through slot 46 in triangular steering block 21, with backrest support 8 in position A. Linkage means 30 (not shown) in slot 46 of triangular steering block 21 may be in either position C (setting for lighter users) or in position D (setting for heavy users). In this context positions C and D define the end positions of the stepless weight setting. Position C is the setting for the minimum body weight that can be set for a seat user, and position D is the setting for the maximum body weight that can be set for a seat user. A change in the position of linkage means 30 brought about by gear system 32 and the associated spindle 51, which is represented here without a component 52, causes the first pivot point 31 of force accumulator unit 2 (not shown) to shift from position C to position D, and therewith also by a length not exceeding E. As was explained earlier, length E can be used to influence the maximum possible body weight range of the weight setting, wherein a short length E means a small range (80 kg to 100 kg) and a long length E means a large range (50 kg to 120 kg) while the force accumulator unit, particularly the force accumulator, remains unchanged.

FIG. 15 shows a top view of an embodiment of a mechanism 1 according to the invention for a chair, particularly a work or office chair, with section planes, E-E, F-F and G-G. FIG. 15 further shows bearing yoke 5 with translational bearing 16, backrest support 3, adjuster 11 for operating gear system 32, and a further adjuster 12 for adjusting the tilt angle of a seat surface structure (not shown). Gear system 23 for setting the tilt angle of the seat surface structure is also shown in addition to gear system 32 for setting the linkage means 30 (not shown).

FIG. 16 represents the section E-E shown in FIG. 15 through mechanism 1 according to the invention, also referred to as a non-orbiting gear system, wherein section E-E cuts away the wall of bearing yoke 5. In second pivot point 34, force accumulator unit 2 is arranged in fixed manner so as to be rotatable by means of first guide element 28 and in first pivot point 31 (not shown) is connected by linkage means 30 to triangular steering block 21 via second guide element 29 of force accumulator unit 2. Bearing lever 19 is arranged so as to be rotatable about the horizontal axis 20 of bearing yoke 5 and is located in a rear base position. Force accumulator unit 2 is in position D, which is brought about by a fully extended spindle 51, and is therefore in the lowest position in slot 46 on triangular steering block (weight setting for heavier persons). A seat support 8 (not shown) is in the horizontal position, and backrest support 3 is in a position A (working position). In addition, support 9 of seat support 8 (not shown) is also connected to connector 10 via a spring-loaded structure, in the same way as in FIG. 2.

FIG. 17 shows a section F-F through mechanism 1 according to the invention. Section plane F-F intersects the drawing of FIG. 15 in such manner that a first bearing lever 19 and the wall of bearing yoke 5 do not appear. In FIG. 17, a second bearing lever 19, arranged on the other side of triangular steering block 21, is represented. A borehole 42 in triangular steering block 21 is also visible, in which the bearing lever 19 (not shown) is arranged so as to be rotatable through bearing lever bearing 40. A horizontal axis 24 which provides the connection between connector 10 and triangular steering block 21 is also visible. Connector is furnished with a curvilinear slot 35, in which a further linkage means 22, particularly a bolt, is accommodated, which bolt is connected to seat support 8 (not shown) via a construction that is particularly spring-loaded.

FIG. 18 shows the central section G-G through the embodiment of mechanism 1 according to the invention, which is also referred to as a non-orbiting gear system, of FIG. 15. FIG. 18 further shows the linkage between force accumulator unit 2, in this case of second guide element 29, to triangular steering block 21 in pivot point 31 via linkage means 30. However, the possibility also exists to arrange force accumulator unit 2 directly on triangular steering block 21. Spindle 51, which acts on line of action 61 of force accumulator unit 2, is also shown. First guide element 28 of force accumulator unit 2 is mounted in fixed manner so as to be rotatable about second pivot point 34. Support 9 of seat support 8 (not shown) is also connected to connector 10 via a spring-located construction (not shown), in the same way as was shown in FIG. 16.

FIG. 19 is a view from below of the mechanism 1 according to the invention for a chair, particularly a work or office chair. FIG. 19 particularly shows bearing yoke 5 with backrest support 3 arranged so as to be pivotable and rotatable, and seat support 8 is in a horizontal position A (working position).

FIG. 20 shows a side view of the mechanism 1 according to the invention for a chair, also referred to as a non-orbiting gear system, in which backrest support 3 is in a position A (working position). Seat support 8 is in a horizontal position. Force accumulator unit 2 is in position D for heavy seat users, that is to say linkage means 30 is in the bottom position in slot 46 of triangular steering block 21. The two bearing levers 19, which are each connected to triangular steering block 21 in a horizontal axis 20, are in a base position in which they are tilted backwards.

FIG. 21 is a view from below of the inventive mechanism 1 for a chair, in which in the detailed view backrest support is shown with main pivot bearing 7 and with the attachment of force accumulator unit 2, particularly of second guide element 29 to triangular steering block 21 via linkage means 30 in the first pivot point 31. Main pivot bearing 7 is mounted on bearing yoke 5 (not shown) in fixed manner so as to be rotatable about a horizontal axis 6. The bearing levers 19 arranged on each side of triangular steering block 21 are also shown from below. In addition, the connection of the two connectors 10 to triangular steering block 21 and backrest support 5 also shown, in this case as threaded joints.

FIG. 22 shows two side views of the mechanism 1 according to the invention for a chair, particularly a work or office chair, also referred to as a non-orbiting gear system, in a first position A (working position) and in a second position B (relaxing position), wherein not all of the structural elements of the mechanism 1 are represented. From position A, position B is reached when a seat user pivots backrest support 3 about the horizontal axis 6 of main pivot bearing 7 in the direction of arrow 62, wherein the pivoting motion is limited by limit stop 47 against bearing lever 19. In position A, both bearing levers 19 are tilted slightly backwards, that is to say in the direction of a backrest (not shown), and, as is evident from the linkage means 30 in slot 46 of triangular steering block 21, force accumulator unit 2, which is shown in part, is in position C, that is to say in an upper end position of the stepless weight setting, which is suitable for people with lower body weight. Thus, the synchro mechanism, and the force accumulator unit 2 with the force accumulator in the embodiment shown are set for lighter persons. In the embodiment, a force accumulator (not shown), particularly a helical screw, has a length of 115 mm in position A. When the seat user leans back, mechanism 1 is moved from position A into position B. The chair thus performs a pivoting motion about horizontal axis 6 of main pivot bearing 7 in the direction of arrow 62. The pivoting motion about horizontal axis 6 of main pivot bearing 7 causes the two bearing levers 19 to shift about a horizontal axis 20 of bearing yoke 5 (not shown) from a rear base position into a front position, according to dashed arrow 63. This in turn exerts a compressive load on force accumulator unit 2, particularly a progressive helical spring. Triangular steering block 21 rotates both about the horizontal axis 24 of connectors 10 and about the horizontal axis 26 of bearing levers 19 simultaneously with the rotating motion of the bearing levers 19. Accordingly, when shifting from position A to position B, triangular steering block 21 simultaneously performs both a first rotary motion about horizontal axis 24 of connectors 10 according to dashed arrow 64, and a second rotary motion about horizontal axis 26 of bearing levers 19 according to dashed arrow 65. As a result of these two rotating motions, that is to say about horizontal axis 24 of connectors 10 and about horizontal axis 26 of bearing levers 19, triangular steering block 21 is reorientated from a vertical position (see position A) to a more horizontal position (see position B). The effect of said two rotary motions by triangular steering block 21 is to exert still greater compressive load on force accumulator unit 2. In particular, progressive force accumulators, particularly springs, are used, i.e., as the load increases the spring becomes harder to prevent bottoming out under heavy loads. In the exemplary embodiment, when the chair is in position B, the force accumulator, particularly the helical screw of force accumulator unit 2 has a length of only 104 mm. The force accumulator of force accumulator unit 2 has thus been compressed by 11 mm. At the same time, when backrest support 3 performs a pivoting motion of such kind about main pivot bearing 7, seat support 8 (not shown here) is forced to replicate the motion of backrest support 3 by the at least one support 9 on the connectors 10, and this in turn causes translational bearing 16 (not shown) of seat support 8, which is in the front area of seat support 8, to shift in translational manner towards the backrest. Seat support 8 does not necessarily have to participate in this motion.

As in FIG. 22 above, FIG. 23 shows two side views of the mechanism 1 according to the invention for a chair, particularly a work or office chair, also referred to as a non-orbiting gear system, in a first position A (working position) and in a second position B (relaxing position), wherein not all of the structural elements of the mechanism are represented. Linkage means 30, and therewith also first pivot point 31 of force accumulator unit 2, which is only shown in part, is in positions A and B, unlike FIG. 22, in a lower position D in slot 46 in triangular steering block 21. The translational shift of linkage means 30, that is to say of first pivot point 31 from an upper position C to a lower position D in slot 46 of triangular steering block 21 does not cause a change in the length of the force accumulator, particularly a helical spring, and consequently the preload force of the force accumulator of force accumulator unit 2 also remains the same. However, due to the aforementioned translational shift of linkage means 30 from the upper position C to the lower position D in slot 46 of triangular steering block 21, the tilt angle (working angle) of force accumulator unit 2 through spindle 51 belonging to gear system 32 is changed, and this in turn changes the line of action of force accumulator unit 2 and accordingly of the force accumulator as well, on the triangular steering block. Force accumulator unit 2 is now in position D. As explained with reference to FIG. 22, position B is reached from position A when a seat user pivots backrest support 3 about the horizontal axis 6 of main pivot bearing 7 in the direction of arrow 62, wherein the pivoting motion is limited by limit stop 47 against bearing lever 19. In position A, both bearing levers 19 are tilted slightly backwards, that is to say in the direction of mounting 4 of a backrest (not shown). When backrest support 3 is in position A, the tilt angle of force accumulator unit 2 may be changed without the application of significant physical force. When the seat user pivots backrest support 3 about the horizontal axis 6 of main pivot bearing 7, triangular steering block 21 rotates from a vertical position to a more horizontal position as described for FIG. 22, and bearing levers 19 are shifted about horizontal axis 20 of bearing yoke 5 (not shown) from a rear base position to a front position, in the direction of dashed arrow 63. Triangular steering block 21 therefore simultaneously performs a first rotary motion about horizontal axis 24 of the linkage point between connector 10 and triangular steering block 21 in the direction of dashed arrow 64, and a second rotary motion about horizontal axis 26 of bearing lever 19 according to dashed arrow 65, and bearing levers 19 are shifted from a rear base position into a front position. This in turn exerts compressive load on force accumulator unit 2, particularly the force accumulator thereof, in this case preferably a progressive helical spring. In this position, the helical screw in the embodiment has a length of 101 mm. In this case, the force accumulator of force accumulator unit 2 was compressed by 14 mm during this setting of the tilt angle of force accumulator unit 2 (position D). The mechanism 1 according to the invention, also referred to as a non-orbiting gear system, thus follows a progression of load curve 66 that demonstrates progressive action on the force accumulator. Since positions A and B of FIGS. 22 and 23 are completely identical, increased compression of the helical spring from 10 mm to 14 mm is achieved by a shift of linkage means 30 from an upper to a lower position in slot of triangular steering block 21. This greater compression of force accumulator unit 2 is accompanied by increasing progression throughout the load curve 66 acting on force accumulator, so that this position (linkage element in position D) is suitable as a setting for heavy seat users, and the setting of force accumulator unit 2 according to FIG. 22 is recommended for lighter seat users. Thus, a method for optimal weight setting for an improved dynamic sitting experience on the part of the seat user by means of mechanism 1 for a chair with synchro mechanism, by which the seat surface structure is moved toward the backrest structure with a synchronised ratio between the two structures, is achieved because the restoring force of the synchro mechanism is set to a different body weight of a seat user by mechanism 1 by changing a working angle of the force accumulator of force accumulator unit 2, wherein with backrest support 3 in a position A the position of force accumulator unit 2 is first shifted with respect to the line of action thereof by means of adjuster via gear system 32, and then seat support 8 is entrained synchronously with backrest support 3 by a pivoting motion of backrest support 3 into position B, wherein seat support 8 undergoes a translational shift in translational bearing 16 in the direction of the backrest and a rotary movement in the direction of arrow 62 about a horizontal axis 6 of main pivot bearing 7, on which backrest support is mounted so as to be rotatable about bearing yoke 5. Thus, the change in the tilt angle of force accumulator unit 2 is not changed by adjuster 11 via the spindle 51 associated with gear system 32, and a progression of the force accumulator, particularly the helical spring, is achieved due to the fact that the non-orbiting gear system, that is to say the mechanism 1 according to the invention, acts progressively on the force accumulator of force accumulator unit 2 with its load curve 66. The result of the seat user is an improved dynamic sitting experience.

FIG. 24 shows an exemplary load curve 66, which is created by the mechanism 1 according to the invention, also referred to as a non-orbiting gear system, during a swivelling motion from a position A (working position) to a position B (relaxing position). The non-orbiting gear system thus interpolates a load curve 66 that acts progressively on a force accumulator of a force accumulator unit 2. The sections 68 of load curve 66 that are separated by dividing lines 67 each represent the distance the mechanism 1 has travelled per unit of time. Here it is evident that sections 68 become larger in the direction of arrow 69 on load curve 66. Accordingly, the individual sections 68 of load curve 66 provide evidence of a progression acting on the force accumulator.

All features represented here may be essential to the invention both individually and in any combination with each other.

List of reference signs

| | |
|---|---|
| 1 | Mechanism |
| 2 | Force accumulator unit |
| 3 | Backrest support |
| 4 | Mounting |
| 5 | Bearing yoke |
| 6 | Horizontal axis |
| 7 | Main rotary bearing |
| 8 | Seat support |
| 9 | Support |
| 10 | Connector |
| 11 | Adjuster |
| 12 | Adjuster |
| 13 | Height adjustment device |
| 14 | Seat depth adjustment device |
| 15 | Aperture angle limiter |
| 16 | Translational bearing |
| 17 | Seat support guide |
| 18 | Seat support bearing |
| 19 | Bearing lever |
| 20 | Horizontal axis |
| 21 | Triangular steering block |
| 22 | Linkage means |
| 23 | Gear system |
| 24 | Horizontal axis |
| 25 | Borehole |
| 26 | Horizontal axis |
| 27 | Borehole |
| 28 | Guide element |
| 29 | Guide element |
| 30 | Linkage means |
| 31 | Pivot point |
| 32 | Gear system |
| 33 | Slot |
| 34 | Pivot point |
| 35 | Slot |
| 36 | Component half |
| 37 | Component half |
| 38 | Borehole |
| 39 | Borehole |
| 40 | Bearing lever bearing |
| 41 | Horizontal axis |
| 42 | Borehole |
| 43 | Connector bearing |
| 44 | Horizontal axis |
| 45 | Borehole |
| 46 | Slot |
| 47 | Limit stop |
| 48 | Gearwheel |
| 49 | Gearwheel |
| 50 | Linkage means |

-continued

| List of reference signs |
|---|
| 51 Spindle |
| 52 Component |
| 53 Connecting member |
| 54 Borehole |
| 55 Borehole |
| 56 Borehole |
| 57 Device |
| 58 Plane |
| 59 Connection device |
| 60 Linkage means |
| 61 Line of action |
| 62 Arrow |
| 63 Arrow |
| 64 Arrow |
| 65 Arrow |
| 66 Load curve |
| 67 Dividing lines |
| 68 Sections |
| 69 Arrow |

The invention claimed is:

1. Mechanism (1) for a chair having a synchro mechanism by means of which a seat surface structure and a backrest structure are moved in a synchronized ratio relative to one another, wherein the mechanism (1) serves to adjust a restoring force of the synchro mechanism to a different body weight of a seat user by changing a working angle of a force accumulator, and the mechanism (1) includes a seat support (8) for the seat surface structure, a bearing yoke (5), a force accumulator unit (2), a backrest support (3) for supporting the backrest structure, and a translational bearing (16), wherein the mechanism (1) has a triangular steering block (21) and the force accumulator unit (2) is connected to the triangular steering block (21), and the mechanism (1) includes a gear system (32) disposed on the triangular steering block (21) and that can be set by means of an adjuster (11).

2. Mechanism (1) according to claim 1, wherein the mechanism (1) includes a connector (10) which is arranged on the backrest support (3).

3. Mechanism (1) according to claim 1, wherein the mechanism (1) includes a bearing lever (19) which is arranged so as to be rotatable about an axis (20) of the bearing yoke (5).

4. Mechanism (1) according to claim 1, wherein the force accumulator unit (2) is connected to the triangular steering block (21) via a linkage means (30).

5. Mechanism (1) according to claim 1, wherein the triangular steering block (21) is rotatable about a horizontal axis (24) of the connector (10) and about a horizontal axis (26) of the bearing lever (19).

6. Mechanism (1) according to claim 1, wherein the gear system (32) includes a spindle (51).

7. Mechanism (1) according to claim 6, wherein the spindle (51) of the gear system (32) acts on the linkage means (30) in such manner that the position of a first pivot point (31) of the force accumulator unit (2) can be shifted.

8. Mechanism (1) according to claim 7, wherein the first pivot point (31) of the force accumulator unit (2) is shifted at an angle to the line of action (61) thereof.

9. Mechanism (1) according to claim 8, wherein the first pivot point (31) of the force accumulator unit (2) is shifted perpendicularly to the line of action (61) thereof.

* * * * *